US010604961B2

(12) United States Patent
Lane et al.

(10) Patent No.: US 10,604,961 B2
(45) Date of Patent: Mar. 31, 2020

(54) BARRIER SUPPORT ASSEMBLY, BARRIER SYSTEM AND METHOD FOR DEPLOYING A BARRIER SUPPORT ASSEMBLY

(71) Applicant: PANDROL (VORTOK) LIMITED, Surrey (GB)

(72) Inventors: Keith Lane, Conyers, GA (US); Craig Mulvay, Ivybridge (GB); Graham Curtis, Morley-Ilkeston (GB)

(73) Assignee: PANDROL (VORTOK) LIMITED, Surrey (GB)

( * ) Notice: Subject to any disclaimer, the term of this patent is extended or adjusted under 35 U.S.C. 154(b) by 344 days.

(21) Appl. No.: 15/493,855

(22) Filed: Apr. 21, 2017

(65) Prior Publication Data

US 2017/0306643 A1 Oct. 26, 2017

(30) Foreign Application Priority Data

Apr. 22, 2016 (GB) ..... 1607017.9

(51) Int. Cl.

| | |
|---|---|
| ***E04H 17/14*** | (2006.01) |
| ***E04G 21/32*** | (2006.01) |
| ***E01F 13/02*** | (2006.01) |
| ***E06B 9/00*** | (2006.01) |

(52) U.S. Cl.

CPC ..... *E04H 17/1421* (2013.01); *E01F 13/022* (2013.01); *E04G 21/3219* (2013.01); *E06B 9/00* (2013.01); *E04G 21/3233* (2013.01); *E04H 2017/146* (2013.01); *E06B 2009/002* (2013.01)

(58) Field of Classification Search

CPC ..... E04H 17/1421; E04H 17/146; E04H 17/1469; E01F 13/022; E01F 13/024; E04G 21/3219; E06B 2009/002; E04F 11/1817; E01B 5/18; F16B 2001/0035

USPC ..... 256/14, 17

See application file for complete search history.

(56) References Cited

U.S. PATENT DOCUMENTS

| | | | | |
|---|---|---|---|---|
| 6,857,621 | B1 * | 2/2005 | Kamarad | E04H 17/10 256/10 |
| 9,033,314 | B1 * | 5/2015 | Roddy | F16L 3/12 256/1 |
| 2015/0074949 | A1 * | 3/2015 | Tsai | A44B 15/00 24/3.12 |
| 2015/0240516 | A1 * | 8/2015 | Bertato | E04H 17/1421 256/65.03 |

FOREIGN PATENT DOCUMENTS

| | | | | |
|---|---|---|---|---|
| CA | 2638709 | A1 * | 2/2010 | E04F 11/1836 |
| DE | 4404169 | A1 | 10/1994 | |

(Continued)

OTHER PUBLICATIONS

Combined Search and Examination Report dated Oct. 24, 2016 issued from the United Kingdom Patent Office.

*Primary Examiner* — Jonathan P Masinick

(74) *Attorney, Agent, or Firm* — Perry + Currier Inc.

(57) ABSTRACT

A method of deploying a barrier support assembly, which barrier support assembly comprises an upright support through which at least one hole extends, and at least one barrier support. The method including the steps of locating the upright support against a fixed structure and having a magnet of the barrier support extending through the hole in the upright support to make contact thereby magnetically attract to the fixed structure.

2 Claims, 5 Drawing Sheets

(56) References Cited

FOREIGN PATENT DOCUMENTS

| | | | |
|---|---|---|---|
| DE | 102015208944 | A1 | 11/2015 |
| EP | 0462818 | A1 | 12/1991 |
| FR | 2971529 | A1 | 8/2012 |
| FR | 3016650 | A1 | 7/2015 |

* cited by examiner

BARRIER SUPPORT ASSEMBLY, BARRIER SYSTEM AND METHOD FOR DEPLOYING A BARRIER SUPPORT ASSEMBLY

FIELD

The invention relates to a barrier support assembly for a barrier used for rapid deployment in environments such as metro rail tunnels or construction. The invention further relates to a barrier system, including the barrier support assembly, and to a method for deploying the barrier support assembly.

BACKGROUND

Metro rail systems have to undergo regular maintenance which may be performed on specific train tracks (lines) having neighbouring tracks which do not require maintenance. In some cases two such tracks are divided by a row of steel universal columns (UC) (generally tunnels constructed via a 'cut and cover' method). If a track is closed for maintenance but a neighbouring track remains in use, safety barriers may be positioned between the neighbouring tracks to prevent maintenance workers from accidentally walking onto the track that is in use.

In most metro rail systems, particularly underground metro rail systems, there is limited space available for deploying structures such as safety barriers. Therefore, it is desirable to provide a barrier support assembly for the safety barriers which makes use of existing structures in such environments. It is also desirable to provide a barrier support assembly which may be deployed more easily in environments where construction in or around new or existing structures is being carried out.

SUMMARY

An embodiment of an aspect of the present invention provides a barrier support assembly for use in supporting a temporary safety barrier, the barrier support assembly comprising: an upright support through which at least one hole extends in a thickness direction of the upright support from one side of the upright support to the opposite side thereof; and at least one barrier support comprising, on a first side thereof, a fastener for retaining a barrier and, on a second side thereof, opposite to the first side, at least one magnetic connector, each magnetic connector comprising a magnet positioned on a spacer, the spacer having a length substantially equal to a thickness of the upright support, the spacer and the magnet being configured for insertion into one of the holes in the upright support so as to locate the magnet in an offset relationship with respect to that hole where at least a portion of the magnet is in abutment with a portion of the upright support surrounding the hole on the one side of the upright support, locate at least a portion of the fastener in abutment with the opposite side of the upright support so that the upright support is positioned between the said portions of the magnet and the fastener, and locate the spacer within the hole in contact with the upright support.

The upright support is configured for location adjacent to a substantially vertical surface of a fixed ferromagnetic structure such that an end of the upright support is in contact with a substantially horizontal support surface adjacent to the base of the fixed structure. The magnet provides an easy to deploy connector which may be connected to any ferromagnetic material, which is a common composition of the universal columns used in metro systems. The spacer may be smaller in width than the magnet or may be positioned eccentrically with respect to the magnet to allow the magnet to be offset with respect to the hole in the upright support (vertical support).

In order for the magnet to pass all the way through the upright support, the spacer must be equal to or longer than the thickness of the upright support. When the length of the spacer is substantially equal to the thickness of the upright support, and the magnet is passed through the hole and offset, the upright support is held between the magnet and a surface of the barrier support with minimal relative movement.

The upright support has a rear surface, which the fastener-side (the first side) of the barrier support contacts when the magnet is inserted through the hole, and a front surface, on the opposite side to the rear surface, which the magnet partially overlaps (covers) when the magnet is offset from the hole it is inserted through. When the magnet is offset with respect to the hole, a force applied to either the barrier support or the upright support in a direction tending to separate one from the other will result in the magnet being pressed against the upright support. That is to say, a force applied to either support, once offset, to move the supports in the opposite direction to the direction in which the magnet was inserted through the hole, will result in the magnet applying that force to the upright support, and will prevent the supports from being separated. This embodiment provides a barrier support assembly which may be quickly deployed by attaching the magnet to a surface of the universal column. The interlocking nature of the barrier support and the upright support provides the advantage that "peel-off" failure of the connection between the magnet and the surface is reduced. The upright support has at least one through-hole which extends from one side of the upright support to another side (the opposite side), opposite the one side. The at least one hole extends through the upright support in a thickness direction of the upright support.

Optionally, the fastener comprises a clip for retaining the barrier.

The clip may be, for example, a partially-circular or C-shaped clip made of resiliently-deformable material into which a portion of the barrier is inserted. Such a clip has the benefit that the barrier will not detach when force is applied from the side of the barrier support containing the clip. However, from the other side, the barrier may be made to un-clip or detach from the clip on application of sufficient force. This provides the benefit that a safety barrier may prevent a person from accidentally falling through the barrier in the direction for which protection is desired. However, should someone find themselves trapped on the wrong side of the barrier, they need only apply relatively little force to the barrier in order for the barrier to become unclipped from the barrier support. They may then pass to the other side of the barrier and reattach the barrier, once safe.

Optionally, the magnet is made of neodymium.

Neodymium advantageously provides a suitable magnetic pull force for the purpose of this embodiment. Other permanent magnetic materials may also be suitable, taking into account practical considerations. For example, a magnetic material should not provide an excessive magnetic pull force, such that the barrier support assembly cannot be removed once the temporary safety barrier is no longer required. Further, a magnetic material should not provide an inadequate magnetic pull force, such that the barrier support assembly easily detaches from the surface to which it is applied under standard conditions expected in a metro rail environment, including low to moderate levels of vibration.

Optionally, there are at least two such holes in the upright support, and at least one of the barrier supports has two such magnetic connectors, the magnets of those magnetic connectors being positioned for insertion into respective holes in the upright support.

The barrier support may contain two identical, side-by-side magnetic connectors for insertion through two, usually adjacent, holes in the upright support. This additional magnetic connector provides the benefit of increased magnetic strength to attach the assembly to a surface. Further, this arrangement provides added resistance to forces applied to the barrier, when attached, to prevent the magnets detaching from the surface.

The magnetic connectors are preferably aligned, in that they are equal in length so as to contact the surface to which the barrier support assembly is attached together, as will be further elaborated in the specific embodiments described later.

Optionally, the upright support further comprises a stand.

In use the upright support is positioned so as to extend down to a horizontal (or substantially horizontal) surface, for example the ground, beneath the assembly. In order to provide added stability to the assembly, the upright support may include a stand.

Optionally, the upright support is made of a non-conductive material.

Providing an upright support made of a non-conductive material has the advantage that there is less chance of accidental electrocution, during deployment or subsequently. If the upright support is accidentally placed on a live (electrified) third rail, a non-conductive upright support significantly reduces the chance of the installer receiving an electric shock. In metro environments, such electric shocks can be fatal. Therefore, any reduction in this risk is a great benefit. Providing an upright support made of a non-conductive material has the further advantage that the non-conductive material would not interfere with track circuits (i.e. track circuit detection systems) if an upright support were to be left inadvertently in the track environment during service.

Optionally, the upright support is made of glass reinforced plastic.

A preferable, non-conductive material is glass reinforced plastic (also called fibreglass). This material has suitable non-conductive properties as well as having the advantage of being lightweight and having high strength.

Optionally, the barrier support assembly further comprises a detachable bracket.

The bracket is positioned between the fastener and the spacer when observed from a side-on view. The bracket provides a benefit that the distance between the fastener and the magnet may be adjusted and further may be shaped to apply force to the upright support, once the assembly is assembled and the magnet offset, to hold the assembly together.

Optionally, the at least one hole of the upright support has a peripheral shape matching that of the magnet of the magnetic connector.

The outer edge of a hole may be shaped to match the magnet intended to pass through it. In this way, a specific orientation may be given as to how to connect the two parts.

Optionally, the at least one hole is round.

Round holes may be used to make extending the magnets through the holes easier if no particular orientation is desired.

In an embodiment of a further aspect there is provided a barrier system comprising at least two barrier support assemblies as described above and at least one barrier.

When the barrier support assemblies are attached to at least one barrier, the combined parts form a barrier system.

In an embodiment of a further aspect there is provided a method of deploying a barrier support assembly, which barrier support assembly comprises an upright support through which at least one hole extends in a thickness direction of the upright support from one side of the upright support to the opposite side thereof, and at least one barrier support comprising, on a first side thereof, a fastener for retaining a barrier and, on a second side thereof, opposite to the first side, at least one magnetic connector, each magnetic connector comprising a magnet positioned on a spacer, and the spacer having a length substantially equal to a thickness of the upright support, wherein the method comprises: inserting the magnet and spacer of the magnetic connector into one of the holes in the upright support from a first side of the upright support until the magnet is located on a second, opposite side of the upright support; and locating the spacer within the hole in contact with the upright support whereby the magnet is located in an offset relationship with respect to the hole, wherein at least a portion of the magnet is positioned in abutment with a portion of the upright support surrounding the hole on the second side of the upright support and at least a portion of the fastener is positioned in abutment with the first side of the upright support such that the upright support is positioned between the said portions of the magnet and the fastener.

Optionally, the method further comprises; before inserting the magnet and spacer, locating the second side of the upright support adjacent to a substantially vertical surface of a fixed structure made of ferromagnetic material such that one end of the upright support is in contact with a substantially horizontal support surface adjacent to the base of the fixed structure; and after insertion of the magnet and spacer; allowing the magnet to make contact with the vertical surface of the structure, and making any adjustment required to the position of the upright support to ensure that the spacer is located in contact with the upright support.

The fixed structure may for example be a universal column. When positioning the upright support it may be beneficial to place the upright support near the surface for attachment and on a support surface to reduce movement after the magnet contacts the surface.

Optionally, the method further comprises: after inserting the magnet and spacer, locating the second side of the upright support adjacent to a substantially vertical surface of a fixed structure made of ferromagnetic material such that one end of the upright support is in contact with a substantially horizontal support surface adjacent to the base of the fixed structure; and after the magnet is positioned in abutment with the second side of the upright support in an offset relationship with respect to the hole such that the spacer is located in contact with the upright support, allowing the magnet to make contact with the vertical surface of the structure.

BRIEF DESCRIPTION OF THE DRAWINGS

The invention will now be described, by way of example only, with reference to the following Figures, in which.

DETAILED DESCRIPTION

Figure 1:
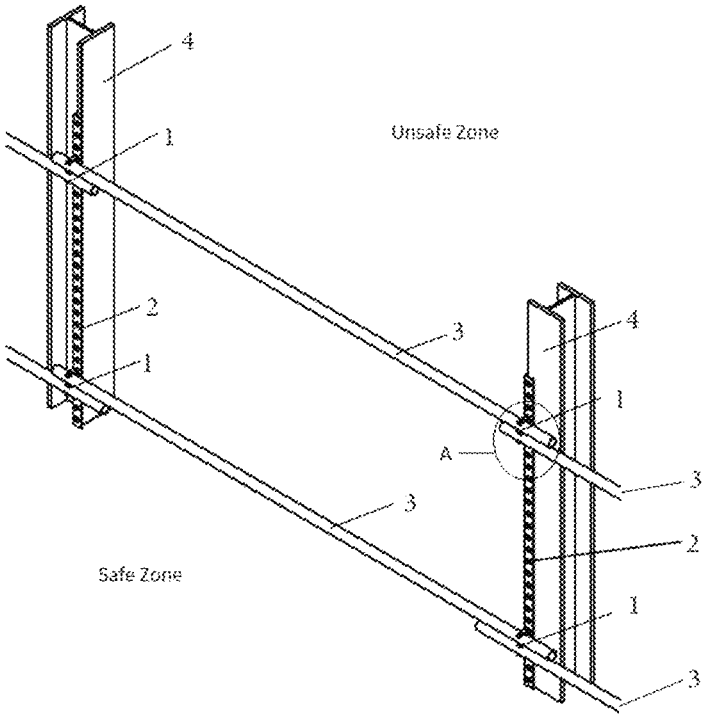
FIG. 1 shows an exemplary embodiment of the barrier system.

In an embodiment of the invention, a barrier support assembly is part of a barrier system for example as shown in FIG. 1. The portion of barrier system 100 shown in FIG. 1 comprises two barrier support assemblies 101, each of which includes two barrier supports 1 and an upright support 2, and two barriers 3 which extend between two barrier support assemblies 101 (portions of other barriers 3 are also shown). Each upright support 2 is positioned to extend substantially vertically along a surface of a universal column 4 which is made of any suitable ferromagnetic material. The length of each barrier 3 is slightly longer than the distance between adjacent columns. In the embodiment, universal columns 4 may be existing columns in, for example, an underground metro rail environment or a construction environment. The columns would typically be located between neighbouring train tracks. Therefore, if a track is closed for maintenance and a neighbouring track remains in use, barriers 3 may be positioned between the neighbouring tracks to prevent maintenance workers from accidentally walking, tripping or falling, onto the track that is in use.

The level of friction generated between a magnet and the surface of the universal column is affected by a number of factors, including how smooth or coarse the surface is and the strength of the magnet. Depending on these factors, friction levels may be low and, as a result, only a small load (the weight of a barrier support itself, for example) might cause the barrier support to slide down the universal column (for example because of vibrations), and/or the force from a person leaning on the barrier might easily displace a barrier support from the universal column. However, providing an upright (vertical) support to transmit vertical loading downwards to a horizontal support surface, preferably to the solid standing of the metro tunnel floor, ensures that this displacement does not happen as a result of vibrations in the metro system or a person leaning on, or even falling onto, the barrier. An upright support may be for example a GRP (glass reinforced plastic) angle section having at least one hole through which the magnets of the barrier support may pass. When assembled, upon application of a downward load, a spacer of the barrier support bears against the inside diameter of the hole in the upright support. A series of holes may be included on the upright support, as shown in the Figures, so that the height of the barrier support may be adjusted, and/or to allow multiple barrier supports 1 to be attached to one upright support 2. In this embodiment, the barrier support assembly is attached to the universal column via permanent magnets packaged in a way to improve the strength of the finished assembly, while only requiring moderately strong magnets.

In this embodiment, the barrier support assembly 101 is configured to interlock into upright supports 2 at each universal column 4 (as required). Barriers 3, which may for example be poles or pipes, are supported by fasteners 10 (described below) of the barrier supports 1 to form a physical barrier for workers. The barriers 3 are preferably made of glass reinforced plastic. During installation, magnets 12*a*, 12*b* (described below) of the barrier support 1 pass through holes in the upright support 2 before being slid downwards to interlock with the upright support. The magnets on the barrier support then snap into contact with the universal columns 4, thereby holding the barrier support assembly 101 in place. The interlocking of the barrier support 1 and the upright support 2 means the capacity of the assembly 101 to withstand vertical load is greatly increased when compared to the magnets on their own.

The general intent behind the arrangement of the barrier system is that a person would not be able to walk through the barrier from the front side (side from which barriers clip in). From the rear side, the barrier is designed to unclip (or the magnets may disengage) so that if anyone is caught on the wrong side of the barrier, they can escape danger.

Figure 2:
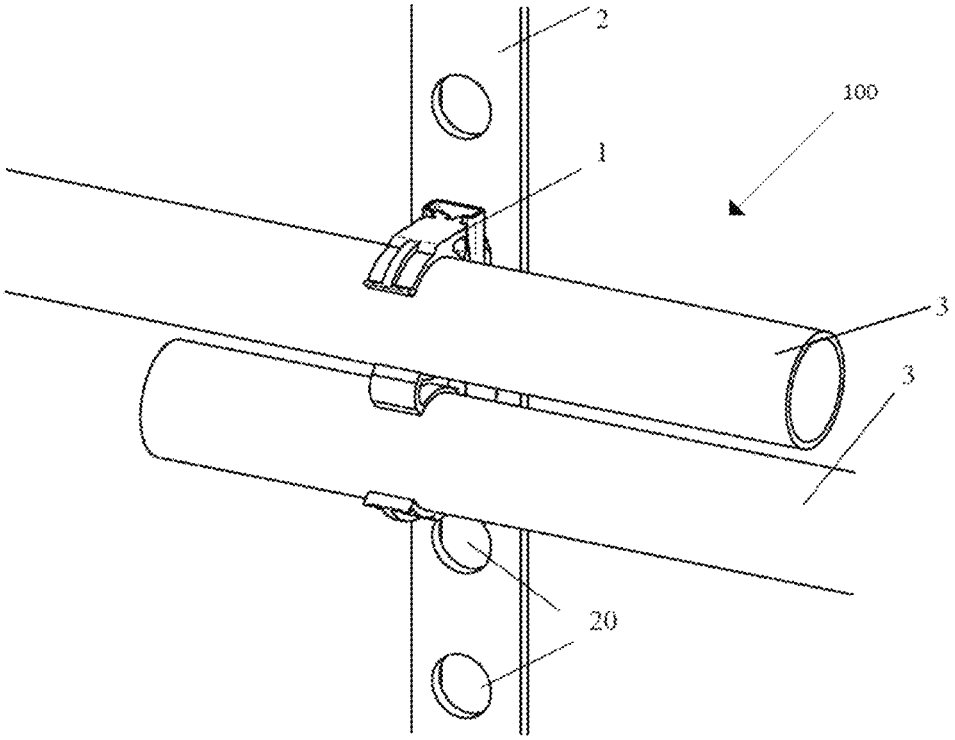
FIG. 2 shows an exemplary embodiment of the barrier support assembly in the barrier system, being an enlarged view of the portion circled A in FIG. 1.

FIG. 2 shows a close-up of an exemplary embodiment of the barrier support assembly 101 attached to two barriers 3 to make the barrier system. In this embodiment, the barrier support 1 includes two clips, for holding the two barriers 3, as fasteners. This embodiment further includes (not shown) two magnetic connectors, which pass through two holes 20 in the upright support 2. As shown, the upright support 2 may include many holes 20, so that the height of the barrier support assembly may be adjusted. This can also be seen in FIG. 1.

Figure 3A:
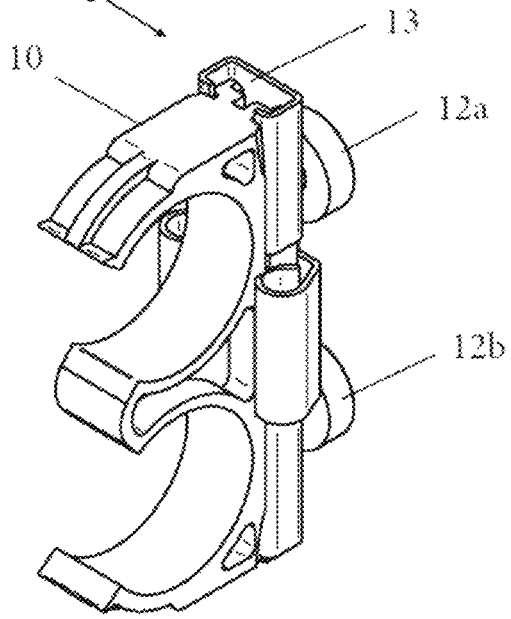
FIGS. 3*a* and 3*b* show perspective and side-on views, respectively, of an exemplary embodiment of the barrier support.
Figure 3B:
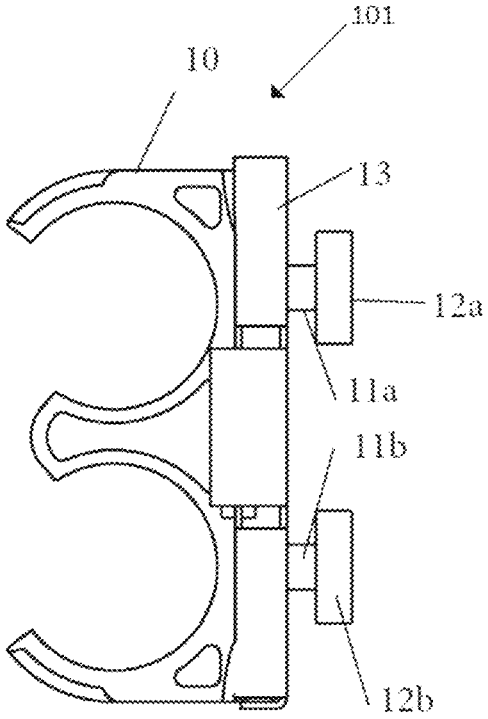

FIGS. 3*a* and 3*b* show an embodiment of the barrier support. The barrier support of this embodiment includes, on a barrier support side (first side), a fastener 10 comprising two clips arranged to clip onto two barriers 3. The clips of the fastener 10 are made of a resiliently-deformable material, preferably nylon (for example, nylon 66). The barrier support 1 of this embodiment further includes, on the opposite side (magnet side) of the barrier support 1 to the fastener 10, two magnetic connectors comprising respective magnets 12*a*, 12*b* for connecting the barrier support 1 to a universal column 4 or similar.

The fastener 10 is preferably configured to retain the barriers 3, but, on application of force from the magnet 12*a*, 12*b* side (second side) of the barrier support, which is opposite the barrier support side, towards the barrier support side (right to left in FIG. 3*b*), the fastener 10 is preferably configured to release the barriers 3. This allows someone located on the wrong side of the barrier 3 to remove the barriers 3 and pass through to the correct side of the barriers 3, and to safety. A nylon fastener 10 is preferably used to provide sufficient elastic deformability when installing and removing the barriers 3. The barriers 3 are preferably made of glass reinforced plastic for its light weight, high strength and non-conductive properties. The clips are arranged to be vertically offset from each other so that the two barriers held by the clips may overlap slightly (as shown in FIG. 1) to avoid either barrier accidentally slipping out of the clip through movement along the axis of the barrier.

As shown in FIGS. 3*a* and 3*b*, the barrier support may include a detachable bracket 13, such as a clip-on bracket or clip bracket. The bracket 13 is preferably made of mild steel with zinc plating. The magnets 12*a*, 12*b*, spacers 11*a*, 11*b* and bracket 13 are fastened together using connectors 14, 15 such as countersunk screws 14 and lock nuts 15 (shown in FIGS. 4, 5*a* and 5*b*). The screws 14 and nuts 15 may be made of A2 or A4 stainless steel, or other suitable non-magnetic material, to make construction easier when passing through the magnet. The fastener 10 is slid into interlocking engagement with the bracket 13 after the magnets 12*a*, 12*b* and spacers 11*a*, 11*b* are attached. The fastener 10 is preferably inserted into the bracket 13 from above. On sliding down, there is a sprung element on the bracket 13 which presses into a recess on the fastener 10 so that it is difficult to remove the fastener 10 from the bracket 13. The bracket 13 includes is an upturned end to prevent downwards movement of the fastener 10 in the bracket 13. The connectors 14, 15 holding the spacers and the magnets connect through the rear face of the barrier clip bracket.

The two magnets 12*a*, 12*b* are positioned on spacers 11*a*, 11*b*, to extend away from the barrier support side of the barrier support 1. The magnets 12*a*, 12*b* extend by an equal distance to each other, so that both contact the surface, to which they are to be attached, together. The magnets 12*a*, 12*b* are preferably made of neodymium with an axial pull strength of 481*b* (or approx. 21.8 kg or 214 N) of force. The spacers 11*a*, 11*b* are preferably made of aluminium or stainless steel. The spacers 11*a*, 11*b* provide a separation between the magnets 12*a*, 12*b* and the barrier support side of the barrier support 1. For example this may be between the magnets and the fastener 10 or between the magnets 12*a*, 12*b* and the bracket 13.

Figure 4:
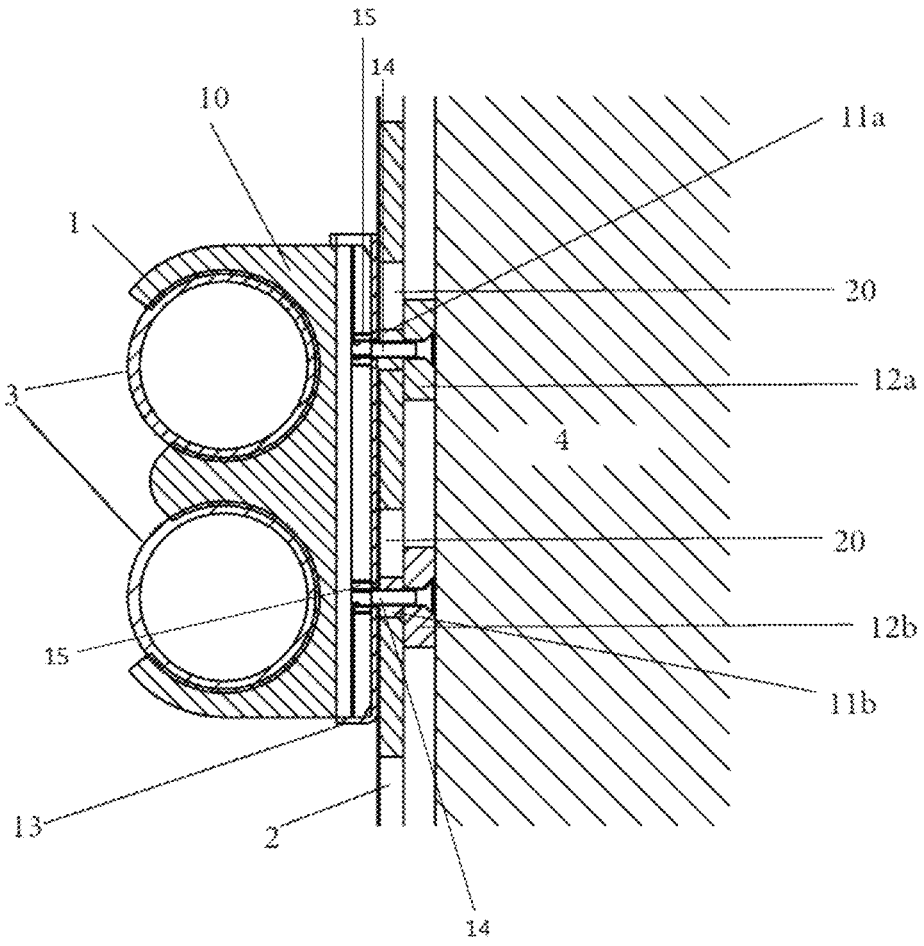
FIG. 4 shows a cross-sectional side-on view of an exemplary embodiment of the barrier system, as attached to a universal column.

During assembly, the magnets 12*a*, 12*b* are aligned with holes in the upright support 2, and then moved through the holes, such that the magnets 12*a*, 12*b* are located on one side of the upright support 2 and the fastener 10 and bracket 13 are located on the other side of the upright support 2, with the spacers 11*a*, 11*b* being located in the holes 20. Then, the barrier support 1 is moved relative to the upright support 2, so that the holes and the magnets become offset with respect to one another. FIG. 4 shows an exemplary embodiment of the barrier support assembly in the assembled position, with the barrier support 1 and the upright support 2 offset. As assembled, the magnets 12*a*, 12*b* and the barrier support 1 extend on either side of the upright support 2, at a part next to the holes through which the magnets 12*a*, 12*b* passed. The upright support 2 extends down to the ground (or another support surface) so that, when the barrier support 1 is in the assembled, offset position, downward forces applied to the barriers 3 or the barrier support 1 are resisted by the spacer 11*a*, 11*b* resting on the side of the hole 20. This embodiment provides an improved vertical load capacity, as vertical load is supported through contact between the spacer 11*a*, 11*b* of the barrier support 1 and the upright support 2.

Figure 5A:
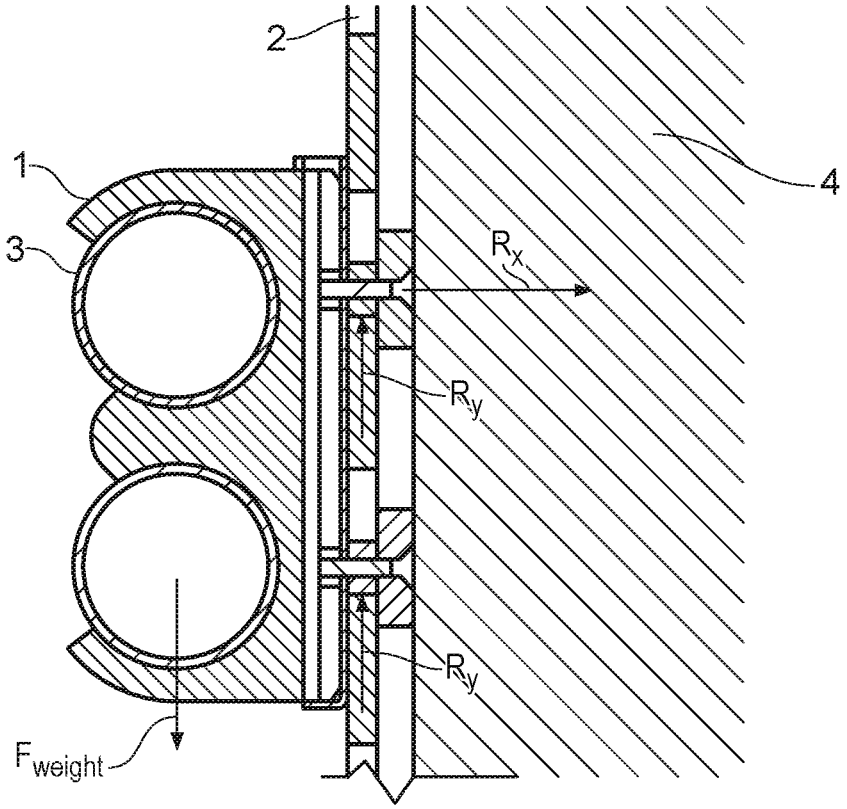
FIGS. 5*a* and 5*b* shows the exemplary embodiment of FIG. 4 as simplified free body diagrams.
Figure 5B:
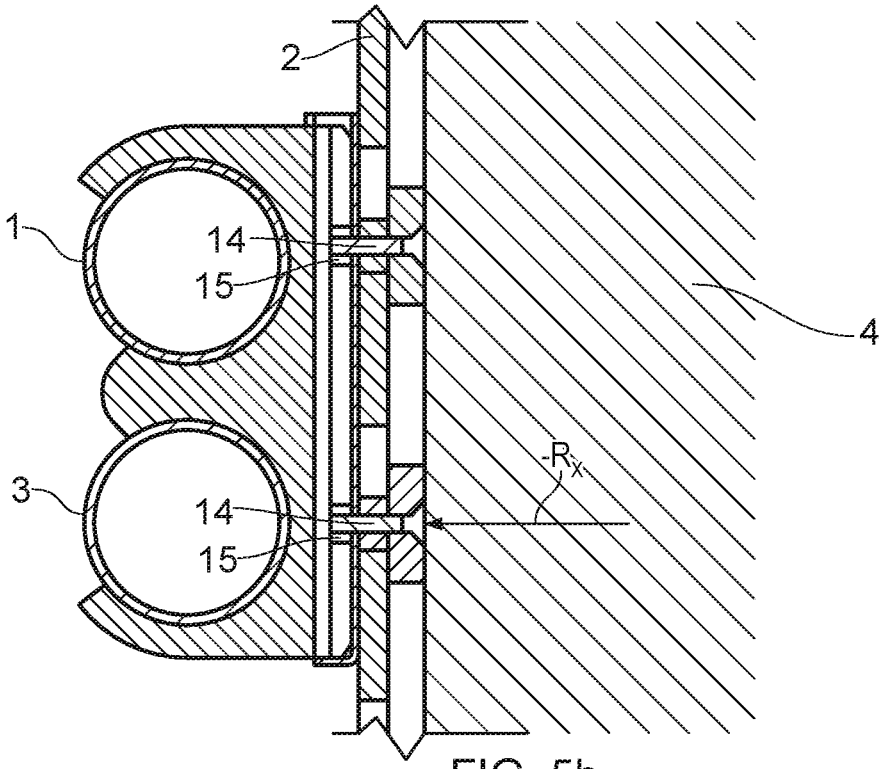

FIGS. 5*a* and 5*b* show the forces acting on the assembled barrier system 100 when attached to the surface of the universal column 4. $F_{weight}$ shows the force acting on the system due to the weight of a barrier 3. This force would be increased if, for example, a person were to lean on the barriers 3. $R_y$ shows the two reaction forces in the vertical direction (Y-axis) applied by the sides of the holes 20 in the upright support 2 against the spacers 11*a*, 11*b* in the barrier support 1. $R_x$ shows the reaction force in the horizontal direction (X-axis) resisting the $F_{weight}$ force. $-R_x$, shown in FIG. 5*b*, shows how the assembly results in the lower magnet directing a force towards the surface of the universal column 4 due to the lever action caused by the $F_{weight}$. Thus, the reaction forces are reduced for the same weight of the barrier support 1 and barriers 3 by interlocking the barrier support 1 with the upright support 2. By increasing the distance between the two reaction loads ($R_x$ and $-R_x$), the magnitude of these reaction loads is lower than if they are closer or adjacent to each other. By reducing these loads, weaker magnets may be used for the same net system strength.

Although the aspects and embodiments are discussed separately, it should be understood that features and consequences thereof discussed in relation to one aspect or embodiment are equally applicable to the other aspects or embodiments. Therefore, where a method feature is discussed, it is taken for granted that the apparatus embodiments include a unit or apparatus configured to perform that feature or provide appropriate functionality.

The invention claimed is:

1. A method of deploying a barrier support assembly, which barrier support assembly comprises an upright support through which at least one hole extends in a thickness direction of the upright support from one side of the upright support to an opposite side thereof, and at least one barrier support, each barrier support comprising, on a first side thereof, a fastener for retaining a barrier and, on a second side thereof, opposite to the first side, at least one magnetic connector, each magnetic connector comprising a magnet positioned on a spacer, and the spacer having a length at least equal to a thickness of the upright support, wherein the method comprises:

inserting the magnet and spacer of the magnetic connector into one of the holes in the upright support from a first side of the upright support until the magnet is located on a second, opposite side of the upright support; and locating the spacer within the hole in contact with the upright support whereby the magnet is located in an offset relationship with respect to the hole, wherein at least a portion of the magnet is positioned in abutment with a portion of the upright support surrounding the hole on the second side of the upright support and at least a portion of the fastener is positioned in abutment with the first side of the upright support such that the upright support is positioned between the said portions of the magnet and the fastener, further comprising:

before inserting the magnet and spacer, locating the second side of the upright support adjacent to a substantially vertical surface of a fixed structure made of ferromagnetic material such that one end of the upright support is in contact with a substantially horizontal support surface adjacent to the base of the fixed structure; and after insertion of the magnet and spacer, allowing the magnet to make contact with the vertical surface of the structure, and making any adjustment required to the position of the upright support to ensure that the spacer is located in contact with the upright support.

2. A method of deploying a barrier support assembly, which barrier support assembly comprises an upright support through which at least one hole extends in a thickness direction of the upright support from one side of the upright support to an opposite side thereof, and at least one barrier support, each barrier support comprising, on a first side thereof, a fastener for retaining a barrier and, on a second side thereof, opposite to the first side, at least one magnetic connector, each magnetic connector comprising a magnet positioned on a spacer, and the spacer having a length at least equal to a thickness of the upright support, wherein the method comprises:

inserting the magnet and spacer of the magnetic connector into one of the holes in the upright support from a first side of the upright support until the magnet is located on a second, opposite side of the upright support; and locating the spacer within the hole in contact with the upright support whereby the magnet is located in an offset relationship with respect to the hole, wherein at least a portion of the magnet is positioned in abutment with a portion of the upright support surrounding the hole on the second side of the upright support and at least a portion of the fastener is positioned in abutment with the first side of the upright support such that the upright support is positioned between the said portions of the magnet and the fastener, further comprising:

after inserting the magnet and spacer, locating the second side of the upright support adjacent to a substantially vertical surface of a fixed structure made of ferromagnetic material such that one end of the upright support is in contact with a substantially horizontal support surface adjacent to the base of the fixed structure; and after the magnet is positioned in abutment with the second side of the upright support in an offset relationship with respect to the hole such that the spacer is located in contact with the upright support, allowing the magnet to make contact with the vertical surface of the structure.

* * * * *